United States Patent [19]

Nakajima

[11] 4,104,821

[45] Aug. 8, 1978

[54] TOY TELEPHONE WITH BELL AND RECORDED MESSAGES

[75] Inventor: Takamitsu Nakajima, Tokyo, Japan

[73] Assignee: Tomy Kogyo Co., Inc., Tokyo, Japan

[21] Appl. No.: 719,530

[22] Filed: Sep. 1, 1976

[30] Foreign Application Priority Data

Sep. 4, 1975 [JP] Japan ..... 50-122677

[51] Int. Cl.[2] ..... A63H 36/30

[52] U.S. Cl. ..... 46/33; 46/175 AR

[58] Field of Search ..... 46/33, 175 AR

[56] References Cited

U.S. PATENT DOCUMENTS 3,771,255 11/1973 Carabet et al. ..... 46/33

FOREIGN PATENT DOCUMENTS 2,012,061 8/1971 Fed. Rep. of Germany ..... 46/33

*Primary Examiner*—F. Barry Shay

*Attorney, Agent, or Firm*—Staas & Halsey

[57] ABSTRACT

A battery powered toy telephone capable of playing in random order any one of several recorded messages, and also capable of intermittent ringing of a bell. Operation of the toy proceeds by turning on a switch, by pressing one or more buttons located below the dial of the toy telephone to cause the bell to ring intermittently, and then by removing the headset to play one of the recorded messages. The messages are recorded in separate grooves on a rotating sound disc that is disengaged from a stylus sliding in contact with a speaker cone by replacing the headset or pressing the strut, which must occur between consecutive messages. The bell rings intermittently only when the toy is turned on, the headset is in place or the strut is being pressed, and one of the buttons is being pressed, or has been pressed since replacing the headset or while depressing the strut.

4 Claims, 7 Drawing Figures

TOY TELEPHONE WITH BELL AND RECORDED MESSAGES

BACKGROUND AND SUMMARY OF THE INVENTION

The present invention relates to a toy telephone capable or reproducing human speech, and of ringing a bell in intermittent fashion. It has long been known to build into a toy telephone mechanisms for reproducing human speech and for ringing a bell continuously. Such prior toy telephone mechanisms have not for the most part allowed several different recorded speech messages to be played back and a bell to be rung intermittently.

This invention reproduces recorded messages according to a random selection process and rings a bell, mounted within the toy, in an intermittent fashion. Both features add realism to the operation of the toy.

The operation of the toy is now explained. The user places the telephone handset in the cradle of the housing causing a strut extending out from the interior of the housing at the cradle to be depressed. Alternately, the user can manually depress the strut but the user must continue to depress until that time in the operation of the toy when the handset is removed from the cradle. Furthermore, if the user wants the bell to ring, he must depress at this stage in the operation of the toy one or more of a plurality of buttons located below the dial of the toy.

The user begins operation of the toy by turning the switch located on the housing to the "ON" position. This completes an electrical circuit within the housing causing a motor to drive several mechanisms located therein. If one of the above-mentioned buttons has been depressed, a mechanism for ringing the bell in conjunction with a mechanism to move the bell to the ringing position, both located within the housing, cause the bell to be rung in an intermittent fashion, i.e., the bell is rung for a period of time and then is silent for a comparable period, and this intermittent ringing continues until the handset is removed from the cradle. If none of the above-mentioned buttons have been depressed, then the intermittent ringing does not occur even when the handset is in the cradle or the above-mentioned strut is depressed since the mechanism for ringing the bell is disengaged.

When the handset is removed from the cradle or the above-mentioned strut is released, the mechanism for ringing the bell and the mechanism for moving the bell to a ringing position are disengaged causing the ringing to cease. Moreover, a rotating sound disc is engaged with the stylus in contact with the speaker cone. Depending on which of the several parallel sound grooves is randomly matched to the stylus, one of several recorded messages is reproduced. Once the stylus reaches the end of the groove, the recorded message ceases and no other recorded message is played back. When the handset is again placed into the cradle or the strut is depressed, the stylus is automatically returned to the position above the beginning of the grooves. When the handset is again removed from the cradle or the strut released the recorded message play sequence is repeated; this sequence can be repeated again and again. The toy ceases to operate internally only when the switch is turned to the "OFF" position.

DESCRIPTION OF THE PREFERRED EMBODIMENT

Figure 1:
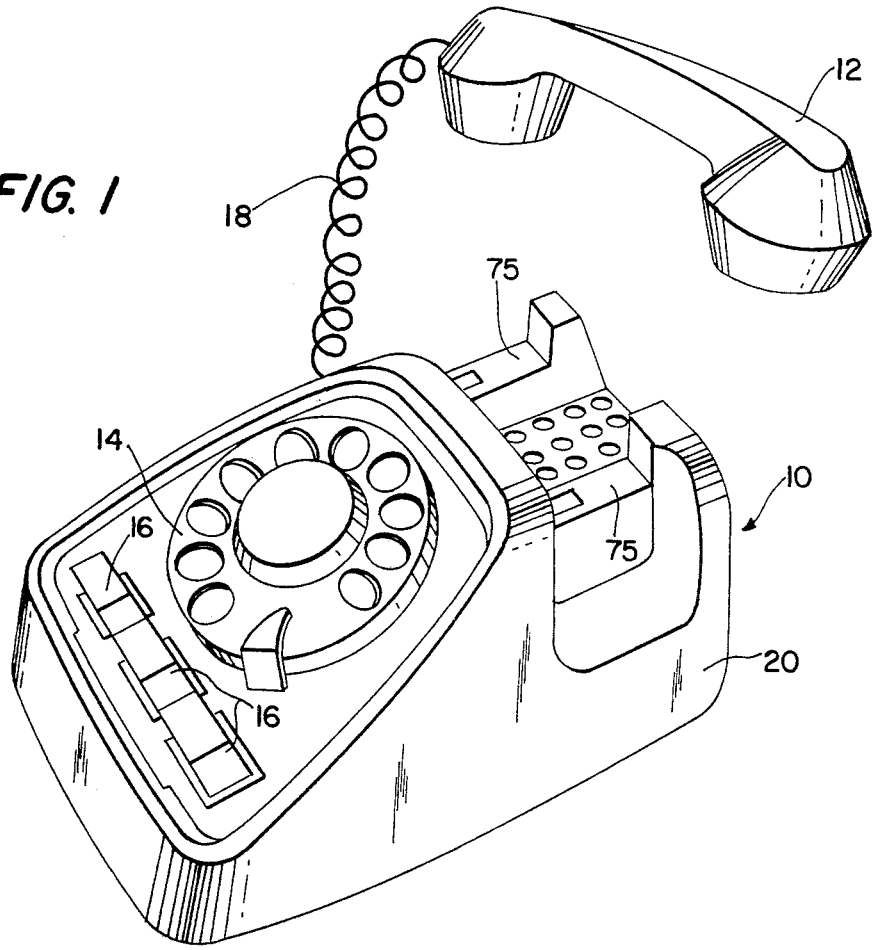
FIG. 1 is a perspective view illustrating the upper section of the housing with cradle, openings in the cradle where the struts pass through, and a handset that fits in the cradle thus moving the struts.
Figure 4:
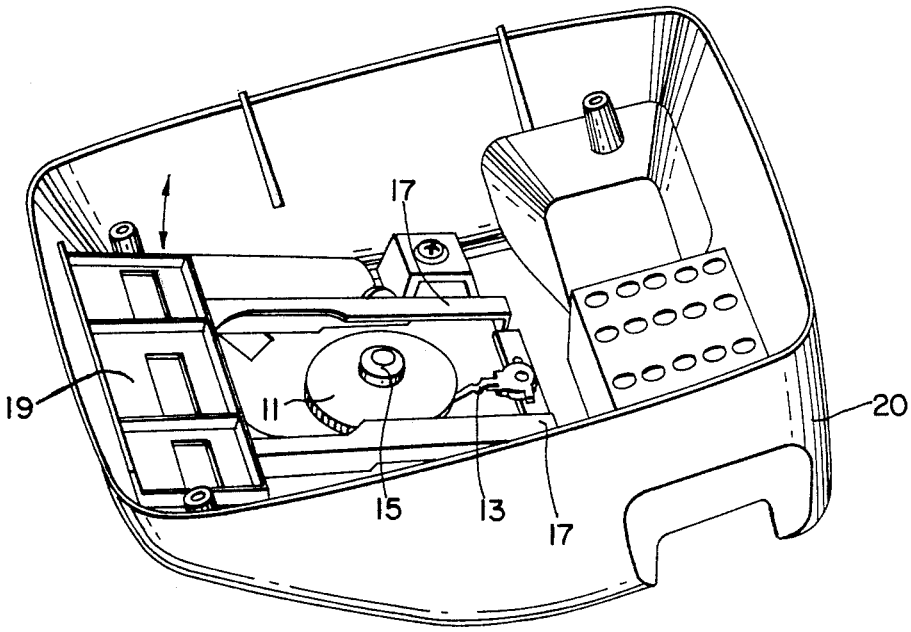
FIG. 4 is a perspective view of the upper section of the housing illustrating the mounting of the buttons for the manually operable plunger system and the arrangement of the dial mechanism.
Figure 7:
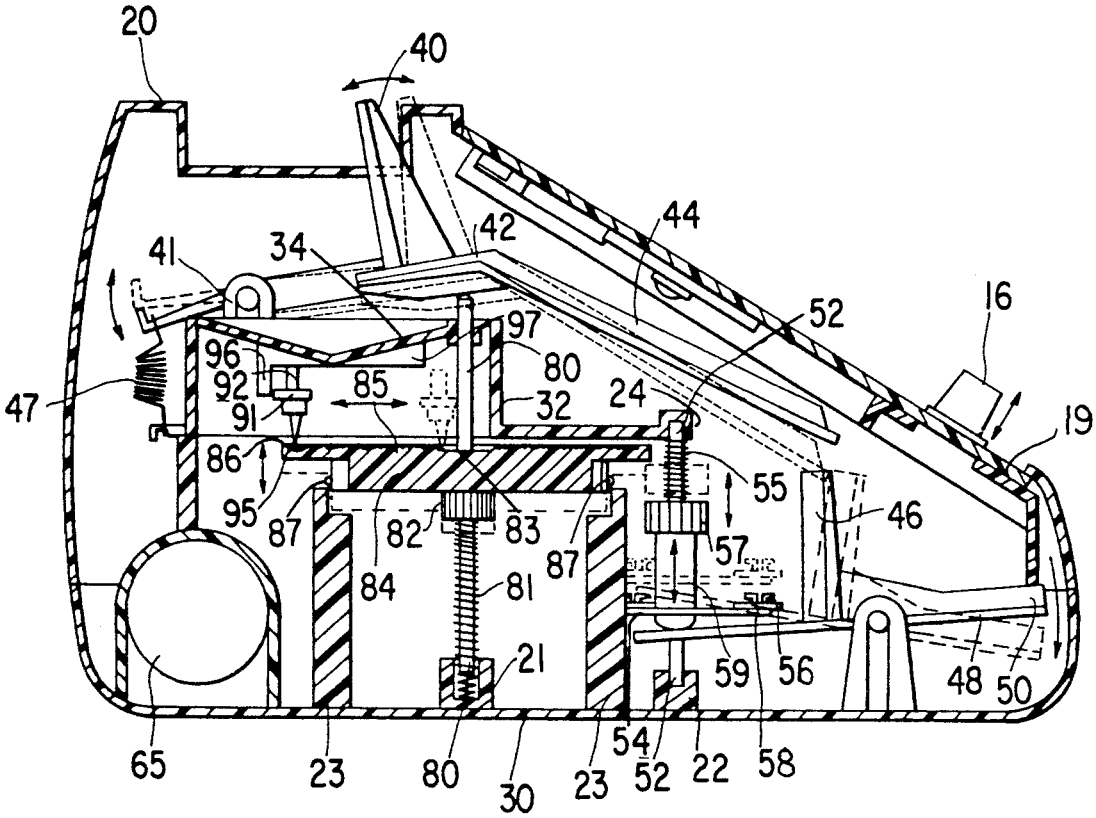
FIG. 7 is a cross sectional view taken along line 7—7 of FIG. 5 illustrating, in particular, the frame for disengaging the stylus from the sound disc grooves and for engaging the mechanism that moves the bell, and the manually operable plunger system in cooperation with the mechanism for ringing the bell.

The toy telephone device of the present invention is designated generally by the reference numeral 10 and comprises, as illustrated in FIGS. 1 and 4, an upper section 20 having a cradle 75 in which headset 12 may be placed, if desired, thus causing strut 40 to be moved, as illustrated in FIG. 7. A dial 14 is rotatably mounted on the exterior surface of upper section 20 and connected to gear 11 on the inner surface thereof by a screw 15, and the teeth of gear 11 contact resilient reed 13 so as to cause a clicking sound when dial 14 is rotated, as shown in FIGS. 1 and 4. Buttons 16 are mounted for reciprocal motion to upper section 20 and are fixed to member 19 which is normally urged against the inner surface of upper section 20 by the spring legs 17, as is apparent from FIG. 4.

Figure 2:
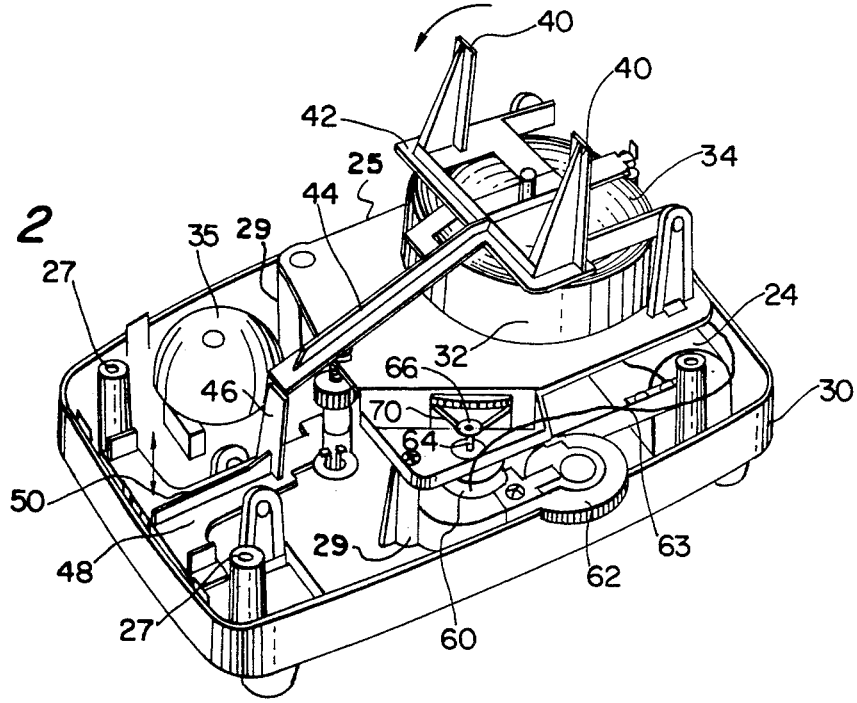
FIG. 2 is a perspective view of the lower section of the housing illustrating the arrangement of the mechanisms located therein, particularly, the relationship of the frame to the spindle for disengaging the stylus from the grooves on the sound disc, and, the line-up of the frame to the manually operable plunger system for engaging the bell ringing mechanism.
Figure 3:
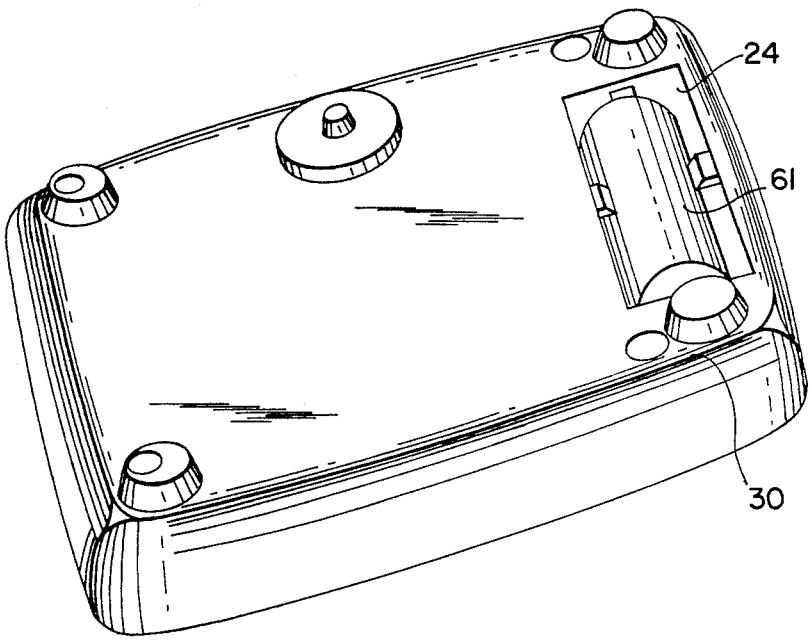
FIG. 3 is a perspective view of the lower section of the housing illustrating the battery's location.

The reference numeral 30 designates the lower section of the housing which, as illustrated in FIGS. 2 and 3, is provided with a compartment 24 within which a source of electrical energy, for example, a battery 65, is located.

Figure 5:
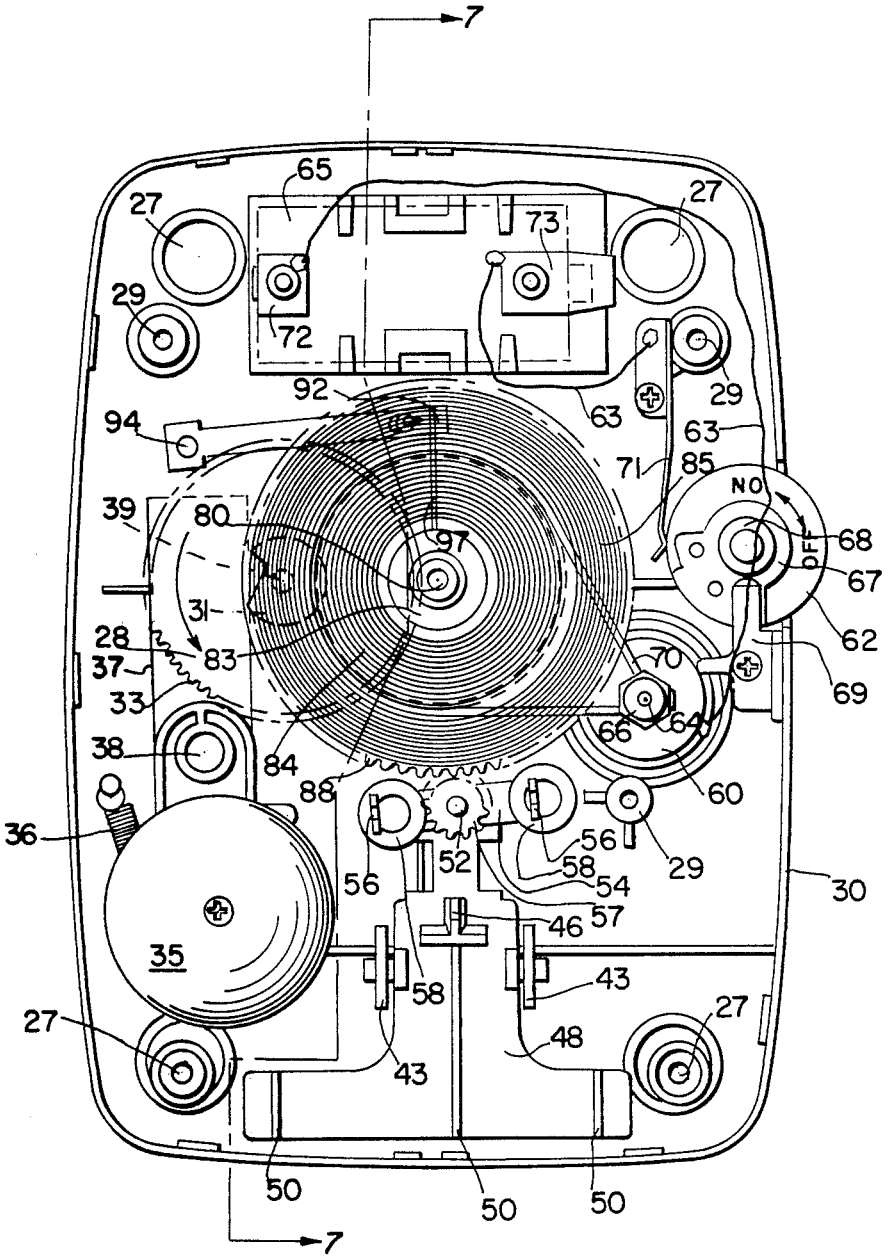
FIG. 5 is a top plan view of the lower section of the housing with the speaker cone and the frame removed.

Turning now to FIGS. 2 and 5, it will be noted that a switch 62 is rotatably mounted by screw 68 to lower section 30 and that a portion of switch 62 extends outwardly of the lower section 30 so as to be manually operable. Mounted on the top surface of switch 62 is electrically conductive ring 67 which, as illustrated in FIG. 5, is always in sliding electrical contact with electrically conductive clip 69. Electrically conductive clip 71 is in sliding, electrical connection with ring 67 depending on the point of rotation of switch 62. Clip 69 is electrically connected to a miniature electrical motor 60, of conventional design, which is appropriately mounted to lower section 30. Motor 60 is electrically connected by wire 63 to battery 65 which, in turn, is electrically connected by wire 63 to clip 71 which completes the series circuit for energizing motor 60. (The switch 62 and other parts shown in FIG. 5 are not repetitively shown in FIG. 6).

As will be apparent from FIGS. 2, 5 and 7, motor 60 is provided with a shaft 64 which engages a resilient belt 70 that surrounds and continuously engages a cylindrical wall 84 which is disposed below and mounted to sound disc 85. Supports 23, which are mounted on lower section 30 are situated next to cylindrical wall 84 and act as retainers to prevent belt 70 from being disengaged with the cylindrical wall 84. Washer 66 is attached to the end of shaft 64, thus constraining belt 70 thereto. It is noted that sound disc 85 is turned by belt 70 which is moved by the rotation of the shaft 64 of the motor 60.

As further illustrated in FIGS. 5 and 7, sound disc 85 is mounted for rotation on spindle 80. A gear 82 is also mounted to spindle 80 for rotation and is disposed below sound disc 85. Spindle 80 terminates downwardly in abutment 21. Spring 82 normally urges the spindle 80 upwardly, as will be apparent from FIG. 7. Spindle 80 passes through a hole provided in speaker cone 34 and terminates upwardly against frame 42, the purpose of which will be described hereinafter.

Figure 6:
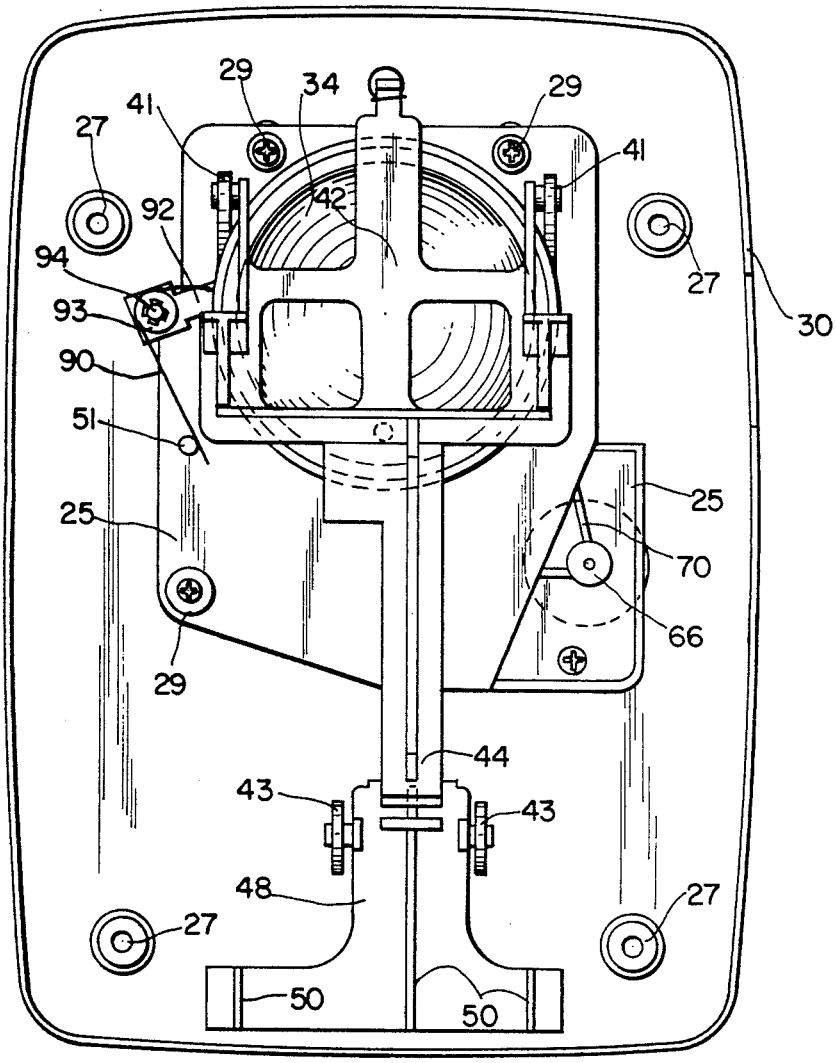
FIG. 6 is a top plan view of the lower section of the housing in which certain portions of the proper assembly adequately illustrated in other figures are not repetitively shown.

Turning now to FIGS. 5 and 6, it will be noted that the reference numeral 92 designates a pick-up arm mounted for rotation about a shaft 94 secured to plate 25 which is fastened to lower section 30 by columns 29, as shown in FIG. 2. As will be apparent from FIG. 6, a small spring element 90, secured at one end to the arm 92 and bearing at the other end against the stop 51 attached to plate 25, normally urges the arm 92 counter clockwise into the position illustrated in FIG. 7. In this position, arm 92 rests against stop 96 which is fastened to rib 97, as shown in FIG. 7. The arm 92 is provided with a platform 91 within which is mounted the stylus 95. The arm 92 engages the rib 97 which is secured to the underside of speaker cone 34 and which passes through the apex thereof. Arm 92 engages rib 97 at all times except when stylus 95 is being constrained by cup 83, the purpose of which will be described below.

As further illustrated in FIG. 5, a gear 28 is rotatably mounted by a shaft 39 to lower section 30. Gear 28 is situated with respect to gear 82 so that teeth 33 of gear 28 become operatively engaged with the teeth of gear 82 when gear 82 is moved downwardly from the normal position thereof, the purpose of which will be described below. A cam 31 is mounted for rotation to gear 28 and is secured to the underside thereof. A rocker-arm 37, mounted for rotation by shaft 38 which is secured to lower section 30, has bell 35 mounted thereon at the end of arm 37 that is away from gear 28. A spring 36 normally urges the other end of arm 37 against cam 31 which causes this end of arm 37 to be in sliding contact with cam 31. Thus, when gear 28 is rotated bell 35 is moved backwardly and forwardly, the purpose of which will be apparent hereinafter.

Turning now to FIGS. 5 and 7, a gear 57 is mounted for rotation to a shaft 52. Also mounted for rotation to shaft 52 is a spacer 59 which is disposed below gear 57 and secured thereto. A bar 54 is also mounted for rotation to shaft 52 and is disposed below spacer 59 and secured thereto. Shaft 52 terminates downwardly in abutment 22 which is attached to lower section 30 and terminates upwardly in abutment 24 which is part of plate 25. If the bar 54, gear 57 and spacer 59 are fixed on the shaft 52, then the length of shaft 52 is such as to allow translational movement thereof, which is not shown in the Figures. Otherwise means must be provided for jointly rotating said bar 54, gear 57 and spacer 59 on shaft 52. A spring 55 normally urges gear 57 downwardly into the position where gear 57 is not operatively engaged, as illustrated in FIG. 7. Located near each end of bar 54 are metal washers 58 which are loosely mounted to bar 54 by prongs 56. The edges of metal washers 54 extend beyond the ends of bar 54, the purpose of which will be apparent hereinafter.

As will be apparent from FIGS. 5 and 7, a lever 48 is pivotally mounted by supports 43 secured to lower section 30. Lever 48 is situated so as to provide for one end thereof to be disposed below bar 54 and for the other end of lever 48 to be below plate 19 which is reciprocally mounted to upper section 20. Spring 55 acting along bar 54 through gear 57, spacer 59 and bar 54 normally urges lever 48 to the position illustrated in FIG. 7. Lever 48 at the end opposite to bar 54 is provided with vertical strut 50 which extends upwardly and terminates within the housing and below and in contact with plate 19 so that when the buttons 16 are manually pushed downwardly, lever 48 rotates and causes bar 54 to be moved upwardly. A vertical member 46 is secured at one end to lever 48, terminates upwardly within the housing and normally occupies the position shown in FIG. 7, the purpose of which will be described hereinafter.

Turning now to FIGS. 6 and 7, it will be noted that plate 25 is positioned above sound disc 85 by supports 29. An upstanding cylindrical wall 32 forms part of plate 25, as shown in FIG. 2, with speaker cone 34 fixedly secured to the upper edge of cylindrical wall 32.

As will be apparent from FIGS. 2, 6 and 7, a frame 42 is disposed above and pivotally mounted by supports 41 to plate 25. A spring 47 and spindle 80 normally urge frame 42 into the position illustrated in FIG. 7. Fixedly attached at one end to frame 42 and extending downwardly within the housing towards member 46 is bar 44, as shown in FIG. 7. Likewise, struts 40 are secured at one end to frame 42 and extend through holes provided therefor in cradle 75 and struts 40 terminate in the cradle area.

Finally, and as illustrated in FIG. 7, when strut 40 is manually moved clockwise from the position shown to that represented by the dotted lines, frame 42 and bar 44 are caused to be moved clockwise and downwardly to the positions shown by the dotted lines. This movement of frame 42 causes spindle 80 to be translated downwardly, thus moving sound disc 84 downwardly to the position shown by the dotted lines which causes stylus 95 to be disengaged from sound disc 85, and also moving gear 82 downwardly to the position illustrated by the dotted lines so as to operatively engage gear 82 with gear 28. Furthermore, if after strut 40 has been moved clockwise as shown in FIG. 7, and if any of the actuating buttons 16 are pressed downwardly, plate 19 pushes supports 50 downwardly so as to cause lever 48 to assume the position illustrated by the dotted lines. This movement of lever 48 causes gear 57 to be moved upwardly to the position shown by the dotted lines so that the teeth of gear 57 become operatively engaged with the teeth 88 that are along the periphery of sound disc 85, as illustrated in FIG. 5. Moreover, member 46 is constrained in the position shown by the dotted lines in FIG. 7 by bar 44 and remains so constrained and thereby keeps gear 57 operatively engaged with teeth 88, until strut 40 is released, notwithstanding whether or not buttons 16 have been released.

The operation of the toy telephone device of the present invention will now be described. Initially the user must either put headset 12 into cradle 75 thus causing struts 40 to be moved clockwise, as illustrated in FIG. 7, or alternately, manually move struts 40 clockwise and hold in that position. This movement of struts 40 causes, as previously explained, both the sound disc 85 to become disengaged from stylus 95 thus allowing pick-up arm 92 to automatically return to its initial position against stop 96, and gear 82 to become operatively engaged with gear 28 which causes bell 35 to be moved backwardly and forwardly to the ringing position when gear 28 is rotated. If the user wishes for bell 35 to ring, he must also depress one of the actuating buttons 16 which causes gear 57 to become operatively engaged with the gear teeth 88 on the periphery of sound disc 85, as shown in FIG. 5. Moreover, bar 44 constrains member 46 in this alternate position despite release of buttons 16 by the operator until struts 40 are released. After the above operations have been done, the user activates the top by turning switch 62 to the "ON" position causing motor 60 through belt 70 to rotate sound disc 85 in a clockwise direction, as illustrated in FIG. 5. Sound disc 85 through gear 82 causes gear 28 to rotate counterclockwise, as shown in FIG. 5, which causes arm 37 to move backwardly and forwardly due to the shape of cam 31. This movement of arm 37 causes bell 35 to be moved in and out of the ringing position. Simultaneously, gear 57, which is operatively engaged with gear teeth 88, is rotated counterclockwise, as illustrated in FIG. 5, causing bar 54 to also rotate counterclockwise and the metal washer 58 attached thereto to strike bell 35 when in the ringing position causing bell 35 to ring. Since bell 35 is only in the ringing position part of the time, this causes bell 53 to be rung in an intermittent fashion. Furthermore, this intermittent ringing will continue until struts 40 are released, as for example, headset 12 is removed from cradle 75.

When struts 40 are released, bell 35 stops ringing intermittently because gear 82 is disengaged from gear 28 and gear 57 is disengaged from gear teeth 88 since spindle 80 is allowed to assume its normal position, as illustrated in FIG. 7. Simultaneously, stylus 95 which is at its normal position above the grooves at the periphery of the sound disc 85, as shown in FIG. 7 and as previously explained, becomes engaged in a random fashion with one of the grooves 86 at the beginning thereof. The stylus 95 thereafter proceeds along the selected groove 86 of the sound disc 85 in the usual manner during which time the platform 92 makes sliding contact with rib 97 of the speaker cone 34 transmitting the sound vibrations from the stylus 95 to the speaker cone 34. When the stylus 95 reaches the end of the groove 86 of the sound disc 85, the stylus drops into cup 83, as shown by the dotted lines in FIG. 7, which prevents arm 92 from automatically returning to its normal position against stop 92. Stylus 95 remains in cup 83 until struts 40 are moved clockwise, as shown in FIG. 7, whereupon, arm 92, under the urging of spring 90, returns to the position against stop 96, as shown in FIG. 7. The play sequence may be repeated as many times as is desired with random selection of the message reproduced as shown in FIG. 7 merely by moving struts 40 clockwise and releasing same for each successive playback. The toy telephone only becomes inoperative when switch 62 is moved to the "OFF" position.

I claim:

1. A toy telephone, comprising:

a housing provided with a cradle;

a spindle, means operatively mounting said spindle within said housing for rotation and reciprocation, said spindle being provided with a first gear, a sound disc mounted on said spindle for rotation therewith, said sound disc being provided with at least one continuous groove, and a continuous rack of teeth along the periphery thereof;

a motor and a source of energy therefor mounted within said housing, and means operatively connecting said motor and said disc for rotating said disc;

a switch mounted to said housing and means connecting said switch with said motor and said source of energy;

a pick-up arm provided with a platform within which is mounted a stylus, means mounting said arm to rotate between a first position wherein said stylus is within the beginning of said groove of said sound disc and a second position wherein said stylus is within the end of said groove of said sound disc, and means normally urging said arm to said first position;

a speaker cone mounted within said housing and provided with a rib, said platform of said pick-up arm making sliding contact with said rib during movement of said pick-up arm betwen said first and second positions;

a second gear rotatably mounted within said housing and being provided with a cam, a rocker-arm, means normally urging said rocker-arm into engagement with said cam, a bell mounted to said rocker-arm, and means mounting said rocker-arm to rotate such that said bell moves between a first non-ringing position and a second ringing position as said second gear and cam are rotated;

a third gear, means operatively mounting said third gear within said housing for rotation and reciprocation between a first position wherein said third gear engages said rack of teeth and a second position wherein said third gear is out of engagement with said rack of teeth, means attached to said third gear to ring said bell when said third gear is rotated and when said bell is in said second ringing position, means normally urging said third gear to said second position: and means moving said sound disc out of engagement with said stylus of said pick-up arm permitting said pick-up arm to move to said first position, while simultaneously operatively connecting said first gear to said second gear, and means for moving said third gear to said first position operatively connecting said rack of teeth of said sound disc to said third gear.

2. A toy telephone as in claim 1, wherein said means attached to said third gear to ring said bell comprises a bar secured to said third gear for rotation therewith, said bar having mounted at each end thereof a metal washer, said washer strikingly engaging the surface of said bell so as to cause a ringing sound when said third gear is rotated and said bell is in said second ringing position.

3. A toy telephone as in claim 1, wherein said means for moving said sound disc comprises a frame, means pivotally mounting said frame within said housing above and in frictional contact with said spindle so as to cause said sound disc to move out of engagement with said stylus when external force is applied to said frame, said frame being provided with a strut attached thereto and terminating upwardly in said cradle of said housing so as to convey external force applied to said strut to said frame, said frame also having a bar attached at one end thereto and terminating downwardly in said housing, the unattached end of said bar being in frictional contact with said means for moving said third gear so as to hold same when said means for moving said third gear has had external force applied thereto and said frame has been moved downwardly.

4. A toy telephone as in claim 1, wherein said means for moving said third gear comprises a bar, means pivotally mounting said bar within said housing, said bar being positioned so that one end thereof is disposed below and in frictional contact with said third gear so as to move said third gear upwardly when external force is applied downwardly to the other end of said bar, a plunger system operatively mounted for reciprocating movement within said housing, said plunger system having at least one end adapted to engage and push against said bar so as to cause said third gear to move upwardly, said plunger system having at least one button fixed to the top thereof and, passing through said housing so as to allow reciprocating movement and terminating above said housing to allow external force applied to said button to be transferred to said plunger system.

* * * * *